US009616985B1

(12) United States Patent
Tucker

(10) Patent No.: US 9,616,985 B1
(45) Date of Patent: Apr. 11, 2017

(54) TWO-PADDLE SYSTEM FOR PADDLE-BOARDING

(71) Applicant: Kerry G. Tucker, Traverse City, MI (US)

(72) Inventor: Kerry G. Tucker, Traverse City, MI (US)

( * ) Notice: Subject to any disclaimer, the term of this patent is extended or adjusted under 35 U.S.C. 154(b) by 0 days.

(21) Appl. No.: 15/139,530

(22) Filed: Apr. 27, 2016

Related U.S. Application Data

(60) Provisional application No. 62/154,779, filed on Apr. 30, 2015.

(51) Int. Cl.
*B63H 16/04* (2006.01)
*B63B 35/83* (2006.01)
*B63B 35/79* (2006.01)

(52) U.S. Cl.
CPC ..... *B63H 16/04* (2013.01); *B63B 35/79* (2013.01); *B63B 35/83* (2013.01)

(58) Field of Classification Search
CPC ..... B63B 35/83; B63H 16/04; B63H 16/00; B63H 16/10
USPC ..... 416/72, 74; 440/101; 441/76, 77
See application file for complete search history.

(56) References Cited

U.S. PATENT DOCUMENTS

| | | | | |
|---|---|---|---|---|
| 3,879,048 | A * | 4/1975 | Penney | A63C 11/222 280/821 |
| 5,558,553 | A * | 9/1996 | Okano | B63B 35/83 440/101 |
| 5,593,334 | A * | 1/1997 | Thayer | B63B 35/83 441/76 |
| 7,607,959 | B2 | 10/2009 | DeMint | |
| 8,100,733 | B1 | 1/2012 | Ross et al. | |
| 8,684,778 | B1 | 4/2014 | Bergman | |
| 8,845,372 | B2 | 9/2014 | Farmer | |
| 2011/0065341 | A1* | 3/2011 | Potter | B63H 16/04 440/101 |
| 2014/0187108 | A1 | 7/2014 | Prade | |

* cited by examiner

*Primary Examiner* — Lars A Olson
(74) *Attorney, Agent, or Firm* — Traverse Legal PLC

(57) ABSTRACT

A one-handed paddle for use in pairs with paddleboards, each paddle comprising a longitudinal main shaft, an axial ski pole type grip on the upper end of the shaft and aligned with the shaft axis, an elongated elastic wrist/arm strap on an upper surface of the shaft near the grip defining a tunnel for the arm generally parallel to the shaft in an unstretched condition, and a blade on the lower end of the shaft, the blade set at an acute upward angle to the main axis of the shaft. The blade has an inverted, rounded L-shape, with an inwardly-facing upper shoulder extending inwardly above and beyond a lower inner edge of the blade, the shoulder configured to ride along the upper surface of a paddleboard during the push portion of a paddling stroke.

15 Claims, 7 Drawing Sheets

FIG. 3
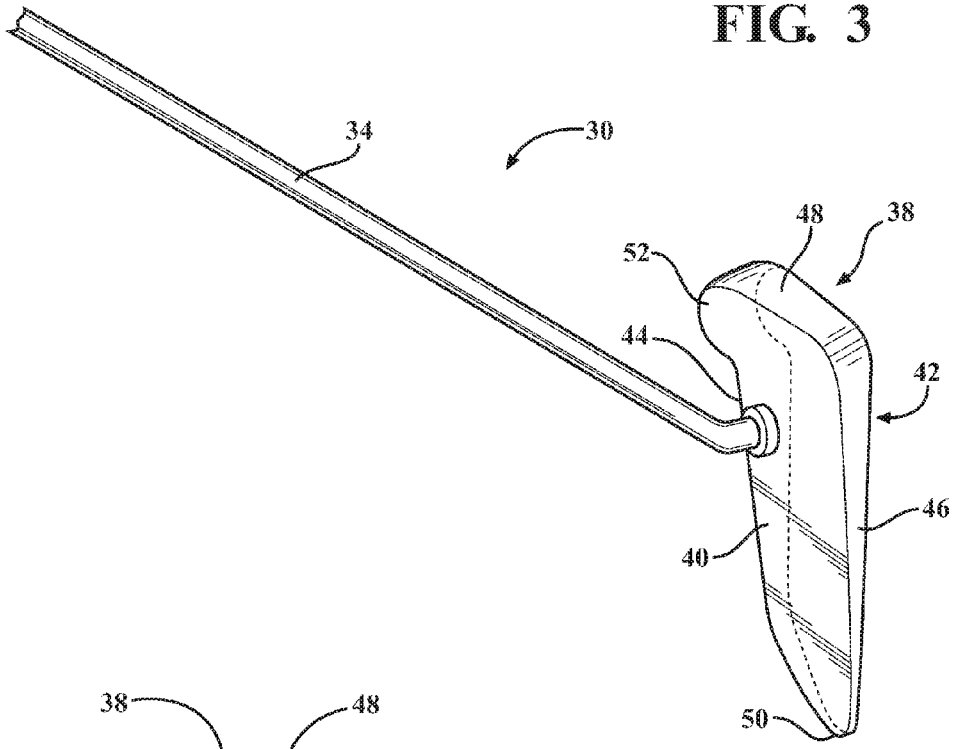
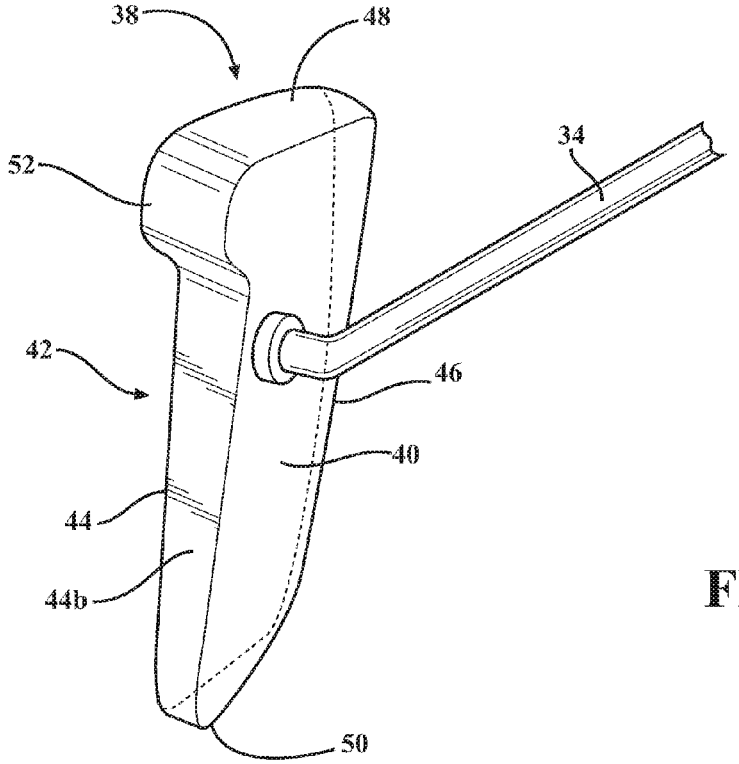
FIG. 4

TWO-PADDLE SYSTEM FOR PADDLE-BOARDING

RELATED APPLICATIONS/PRIORITY BENEFIT CLAIM

This application claims the benefit of U.S. Provisional Application No. 62/154,779, filed Apr. 30, 2015 by the same inventor (Tucker), the entirety of which provisional application is hereby incorporated by reference.

FIELD

The subject matter of the present application is in the field of watercraft paddles, and in particular for paddles used standing up, as in paddle-boarding.

BACKGROUND

Paddleboard paddles are known, used by a paddler while standing upright on a paddleboard. Both single and double paddles are known for paddle-boarding. Paddleboard paddles will be referred to as "board paddles" or "paddles" below.

Single paddles are the most common type, but usually require the paddler to lean off-center and twist the torso, both of which can be uncomfortable. Single paddles also require the paddler to switch sides every few strokes, making an inefficient zigzag track across the water; or, to use J-strokes that keep the board more or less on track, but reduce speed and efficiency. An example is shown in U.S. Pat. No. 8,100,733 to Ross et al (single paddle with optional secondary blade).

Double-bladed paddles are also known, with a single shaft and a blade at each end. These paddles are used somewhat like kayak paddles, and might still require a torso-twisting motion or be difficult for some people to balance standing up; might be awkward due to their length; and/or might have some inherent blade inefficiency due to the entry and exit angles in the water. Examples are shown in U.S. Pat. No. 8,684,778 to Bergman (double paddle with crank shaft) and U.S. Pub. No. 2014/0187108 A1 to Prade (double paddle attached to spar on the board).

Tandem paddles are also known for paddle-boarding, consisting of a pair of paddles, each with its own shaft, but linked to each other directly or through a support or harness worn by the paddler. The paddles allow a balanced, straight stroke on both sides of the board. However, the body supports and harnesses are cumbersome, are believed to be impractical for most recreational paddlers, and might be a hazard if attached to the paddler. An example is shown in U.S. Pat. No. 8,845,372 to Farmer.

U.S. Pat. No. 7,607,959 to DeMint shows a paddle watercraft system with two independent single paddles having ski pole type grips and concave foam blocks for blades, used with a pair of independent pontoon-like floats worn on the feet like skis, to simulate walking on water.

BRIEF SUMMARY

I have invented a two-paddle system for paddle-boarding, comprising two independent, one-handed, single-bladed paddles. Each paddle comprises a ski pole type axial grip aligned with the shaft, an elastic wrist loop on a top side of the shaft near the grip, and a substantially planar, somewhat L-shaped paddle blade on a lower end of the shaft and set at an acute upward angle to the shaft.

The paddle blade comprises a front face, a rear water-pushing face, and a wider upper end defining an inward-facing shoulder shaped to ride along the edge of a paddleboard, with the shoulder remaining above or sliding along the upper surface of the paddleboard during a stroke, and the lower main body of the blade riding alongside and below the paddleboard in the water during a stroke.

In a further form, the rear water-pushing face of the blade is contoured or angled acutely from its inner edge to its outer edge relative to the push plane (a plane defined perpendicular to the plane of the shaft), and from its top edge to its bottom edge. The result is a blade thicker at the inner edge than the outer edge, and thicker at the top edge than the bottom edge, and that reduces the tendency of the blade to stray outwardly from the line of a stroke along the side of the paddleboard.

These and other features and advantages of the invention will become apparent from the detailed description below, in light of the accompanying drawings.

BRIEF DESCRIPTION OF THE DRAWINGS

FIG. 3 is a front outer-edge perspective view of the blade and lower part of the shaft of one of the paddles of FIG. 1.

FIG. 4 is a front inner-edge perspective view of the blade and lower part of the shaft of the paddle of FIG. 3.

DETAILED DESCRIPTION

Figure 1:
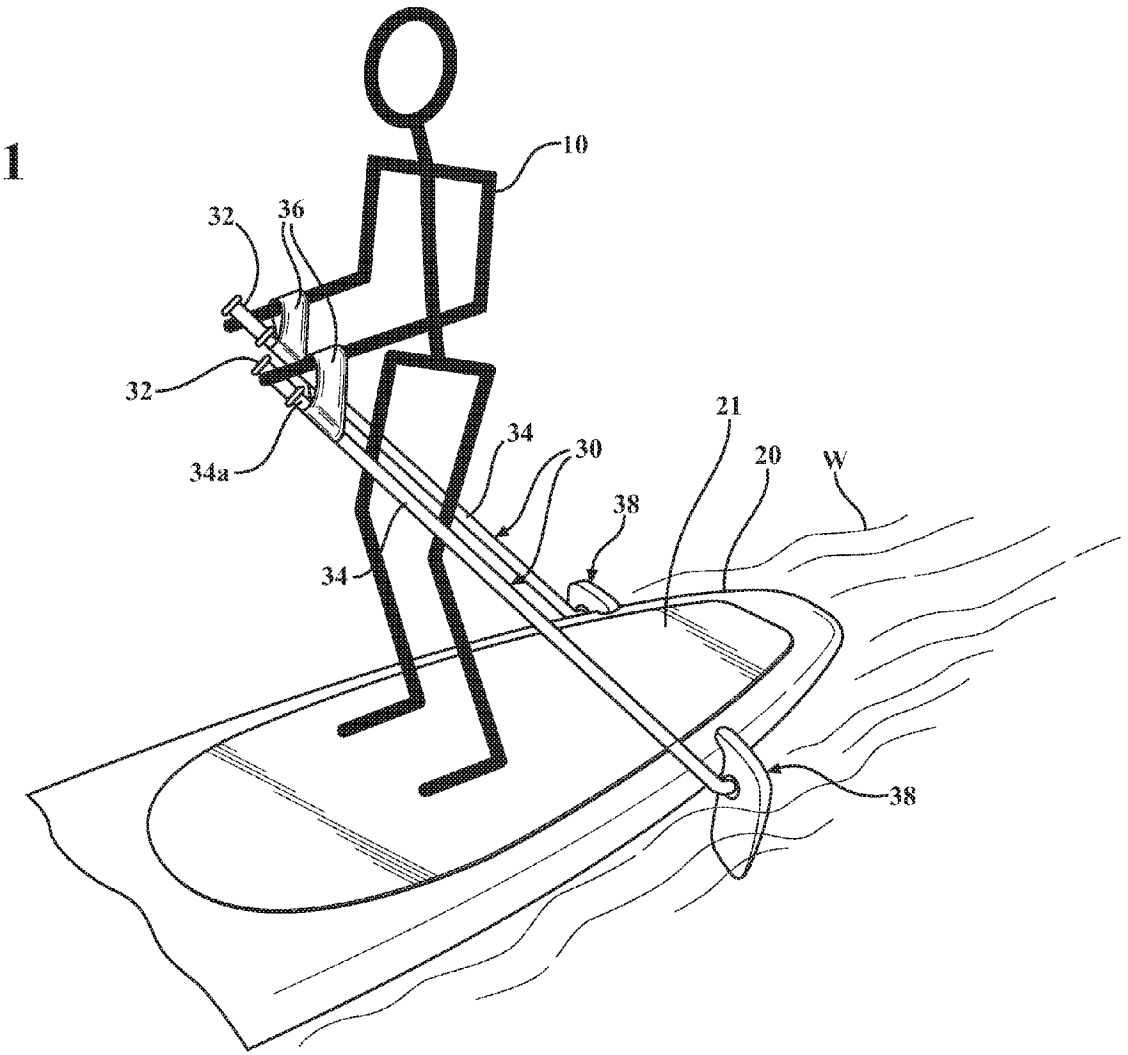
FIG. 1 is a perspective view of a paddler standing on and paddling a paddleboard with a pair of paddles according to the invention.

Referring first to FIG. 1, a paddler 10 on a paddleboard 20 is shown using a pair of paddles 30 according to the invention to paddle board 20 across water W. Paddles 30 are shown in exemplary form in order to teach how to make and use the claimed invention.

Figures 2, 2A:
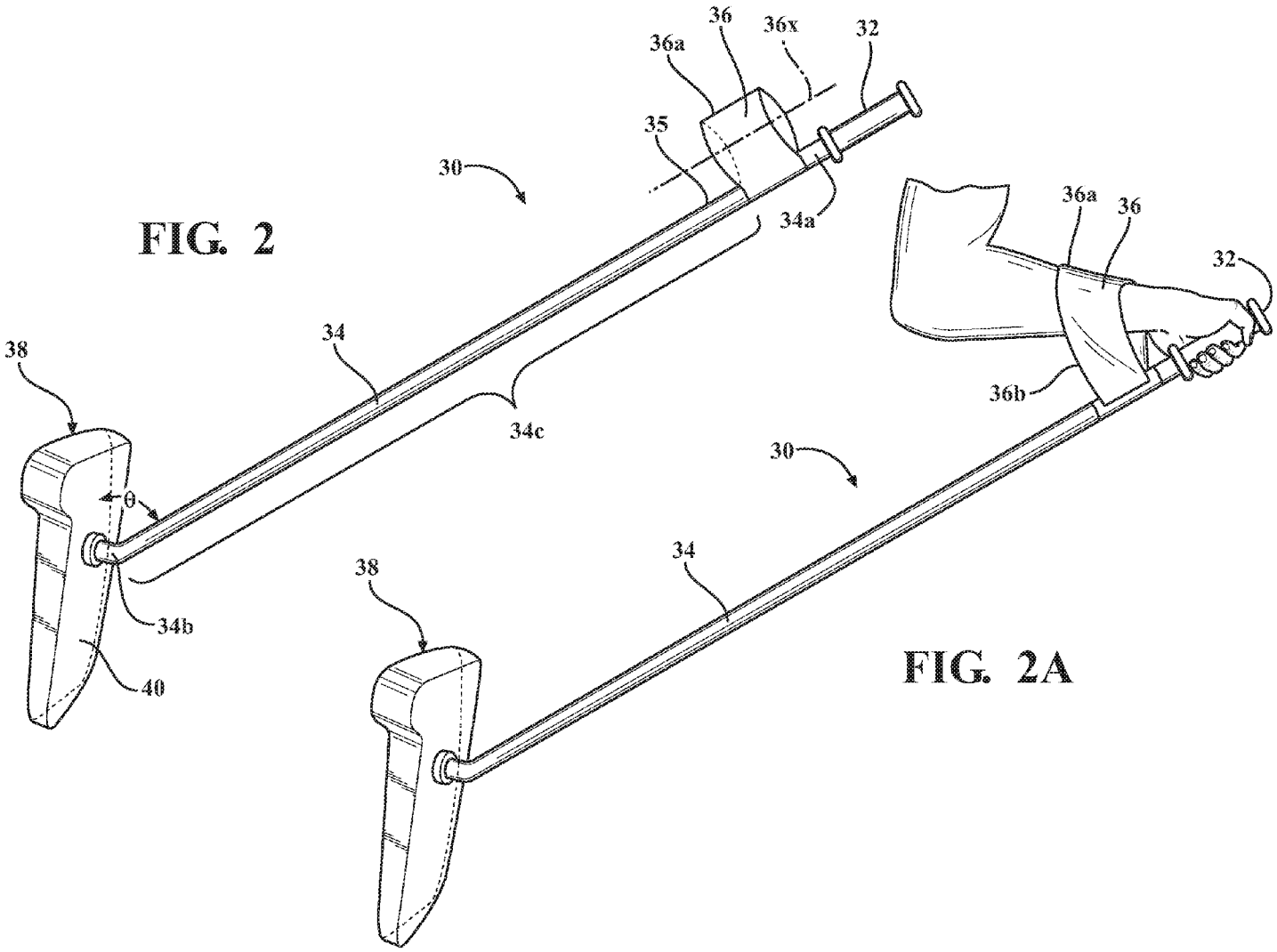
FIGS. 2 and 2A are perspective views of a complete one of the paddles of FIG. 1, showing the wrist/forearm strap in unstretched and stretched conditions, respectively.

Referring now to FIGS. 1 and 2, each paddle 30 in the illustrated example includes a ski pole type grip 32 on an upper end 34*a* of a shaft 34, the grip in axial alignment with shaft 34; an elastic loop or strap 36 located adjacent the grip 32 at the shaft upper end 34*a* of the shaft 34, on an upward-facing side 35 of the shaft and sized to fit around the wrist or forearm of paddler 10; and a blade 38 on the lower end 34*b* of shaft 34.

Blade 38 is set at an upward acute angle θ relative to the main portion 34*c* of shaft 34, i.e. the blade's front face 38*a* defines an acute (less than perpendicular) angle to the axis of shaft main portion 34*c* (the shaft's main longitudinal axis) as measured in a vertical plane aligned with strap 36 on the upper side of shaft 34. In the illustrated example, angle θ is approximately 35 to 45-degrees, with 38 to 40 degrees preferred and 39 degrees having been found to be optimal, although the angle may vary for different paddles, which may be customized in terms of size, angles, and shaft length depending on the paddler's stature, skill level, and comfort.

Blade 38 may be made from various materials such as wood, dense foam, lightweight metal such as aluminum, or various plastics, using known processes such as molding, carving, casting, 3D-printing, etc. Shaft 34 may be made from a similar selection of known materials, and is preferably hollow or foam-cored for light weight and flotation. Grip 32 may be a known type of ski pole grip made from various plastics, cork, synthetic rubber, or the like. In a preferred form, the blade material is a "6-lb" polyurethane foam with dimensions of approximately 17" (inches) tall, 7" (inches) at the widest point, and ¾"-inch at thicker inner edge for the blade, excluding its inwardly-directed shoulder. Other weights of polyurethane foam might be more advantageous for some paddlers or paddling styles, but pours in the 4-8 lb. range have been found to provide a good balance of strength and durability to weight; heavier pour weights are generally too heavy for continuous use by most paddlers, while lighter pour weights may require fiberglass or similar coverings or sheathing to maintain blade strength.

Strap 36 is made from a strong elastic material such as, but not limited to, an elasticized nylon or neoprene rubber, with a width from its front opening to its rear opening sufficient to ensure good, comfortable surface area contact with the paddler's wrist/forearm for paddling leverage, and to provide proper tension relative to its stretched length. As best shown in FIG. 2, strap 36 in its unstretched, at-rest state is substantially parallel to shaft 34, i.e. with its top surface 36*a* and its axis 36*x* through the open ends of the strap essentially parallel to the shaft, it defines a "tunnel" for the wrist or arm, with an orientation generally parallel to the shaft main axis. As best shown in FIG. 2A, however, the elastic nature of strap 36 allows the strap to stretch from its original angle and height, especially at its lower edge or opening 36*b*, so that the shaft 34 is placed in tension relative to a paddler's wrist/forearm when the paddler holds grip 32 at a non-parallel, downward (away from the strap tunnel axis) angle, and so that the strap is stretched at an upward angle relative to the axis of shaft 34 similar to that of blade 38 as best shown in FIGS. 1 and 2A.

When paddles 30 are held at a natural rest position by the paddler, as shown in FIG. 2A, the paddles are held in light tension against the paddler's arms by the straps 36. The paddler rotates a paddle 30 forward to dip it in the water roughly even with or slightly behind the feet of the paddler to set the beginning of a push stroke, with the strap remaining lightly tensioned until the push stroke begins. As the stroke pushes back and along the edge of the paddleboard, the angle between the paddler's forearm and shaft 34 increases, and strap 36 is stretched farther, such that the tension between paddle 30 and the paddler's arm is increased. The stored energy in the strap 36 as the paddle nears the end of the push stroke helps lift and return the paddle 30 to the start position with little effort, an important feature given the one-handed nature of each paddle 30.

The resulting paddle motion is like that of a cross-country skier using ski poles, with the paddles 30 lifting and dipping slightly at the end and beginning of each stroke and gliding in substantially parallel planes along the sides of the paddleboard during the push stroke. This has been found by the inventor to be an efficient and comfortable way to paddle a paddleboard for long distances.

Referring now to FIGS. 3 and 4, paddle blades 38 each have a front face 40, a rear face 42, an inner edge 44, an outer edge 46, an upper end 48, a lower end 50, and an inwardly-facing shoulder 52. The front and rear faces 40, 42 are substantially planar, but are not parallel, since rear face 42 is angled from inner edge 44 to outer edge 46 at an angle that reduces the thickness of the blade at outer edge 46 relative to inner edge 44. Also, both the front and rear faces 40, 42 are angled inwardly from upper end 48 to lower end 50 in a manner that reduces the thickness of the blade at lower end 50 relative to upper end 48. These blade-narrowing angles make the blade somewhat wedge-shaped, both front to back and top to bottom. The resulting geometry, along with an off-center connection of blade 38 to shaft 34 that places the shaft nearer the blade inner edge 44 than the outer edge 46, helps to reduce the tendency of blade 30 to drift outwardly, away from the paddleboard, toward the end of a stroke.

Paddle blades 38 in FIGS. 1-5 show the shaft 34 attached to the blade front face 40 at a point closer to upper end 48 than to lower end 50, i.e. offset above the approximate midpoint X of the blade.

Figure 5:
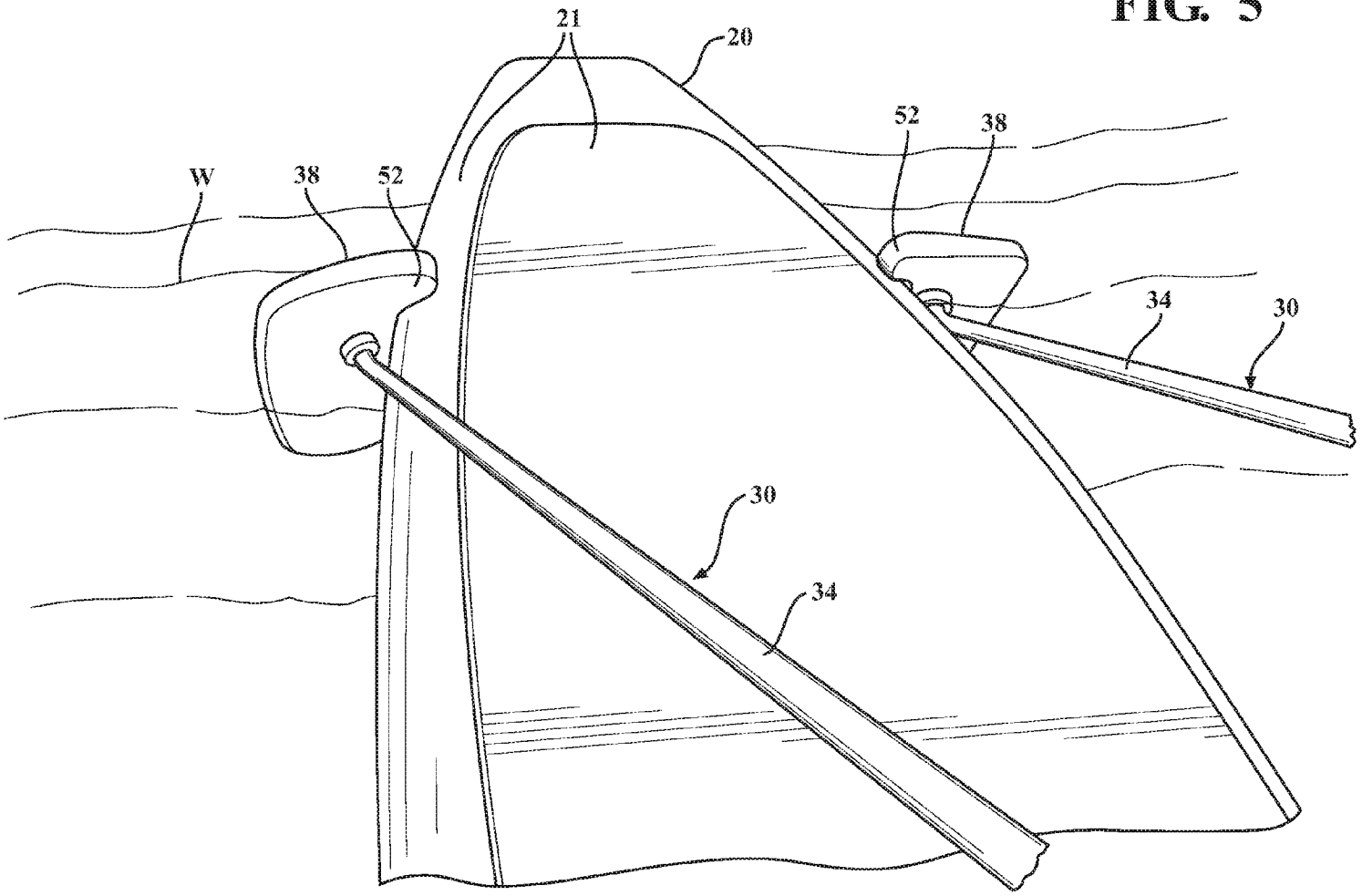
FIG. 5 is a detail perspective view of the paddles of FIG. 1 riding along the sides of the paddleboard, viewed from the front of the board, toward the end of a simultaneous stroke.
Figure 6:
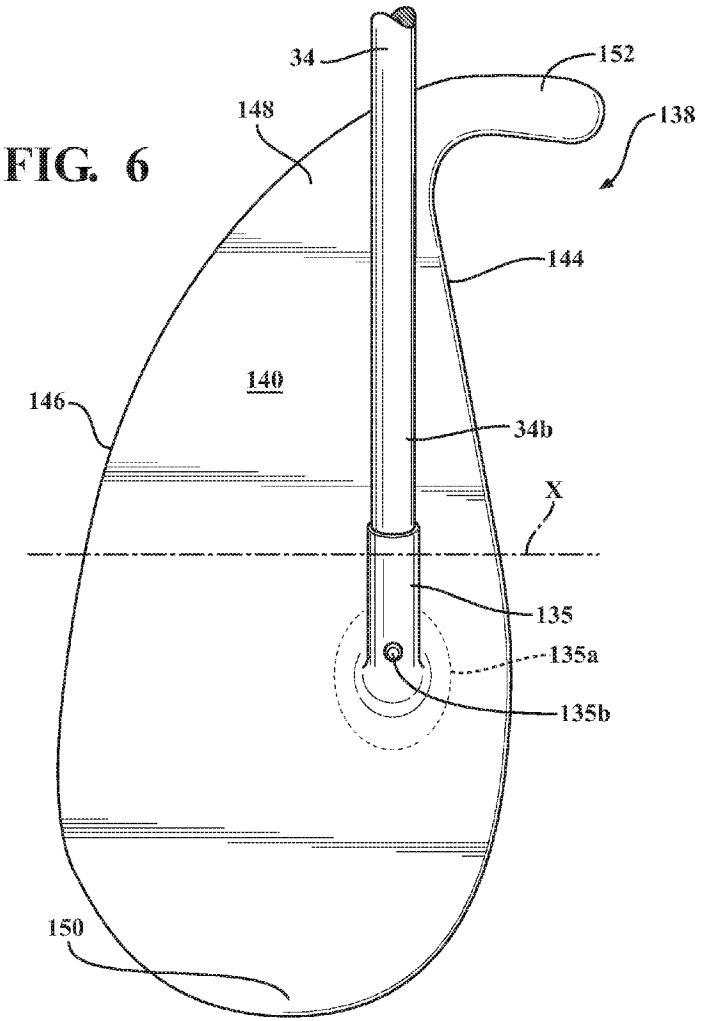
FIG. 6 is a front elevation view of a modified paddle blade for use on the paddles of FIGS. 1-5.
Figure 7:
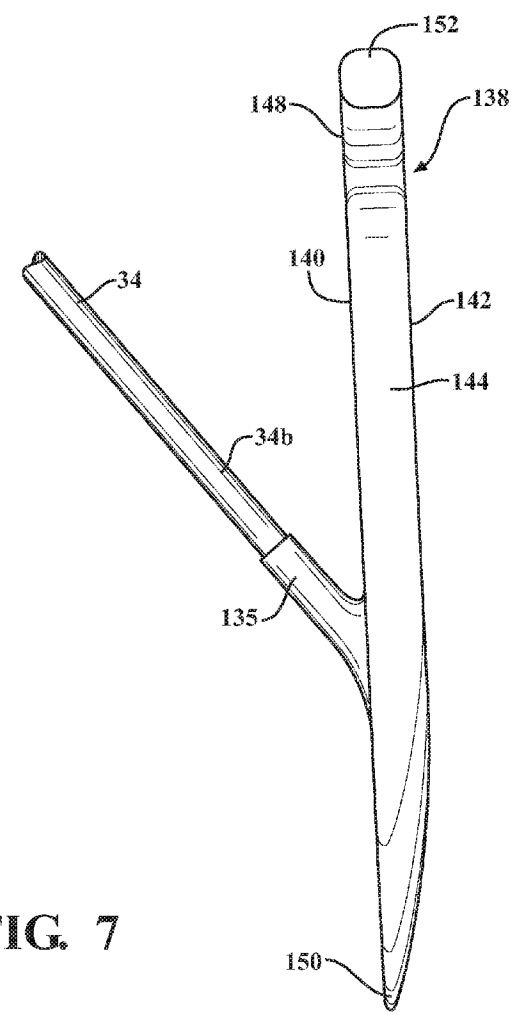
FIG. 7 is an inner-edge side elevation view of the paddle blade of FIG. 6.
Figure 8:
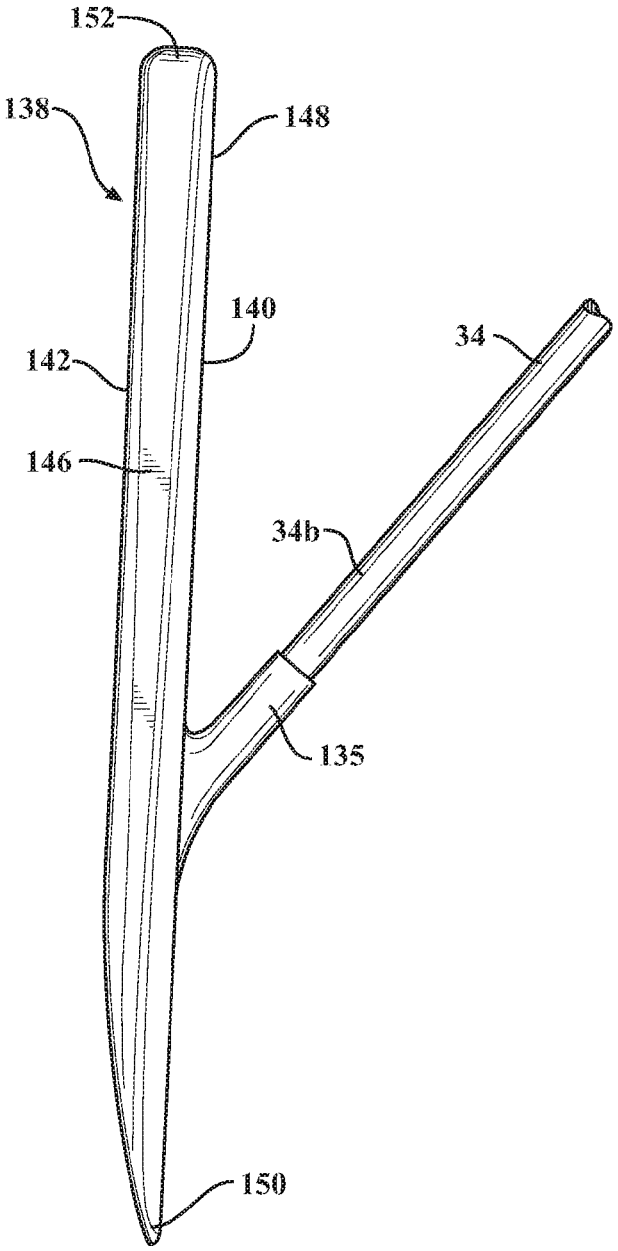
FIG. 8 is an outer-edge side elevation view of the paddle blade of FIG. 6.
Figure 9:
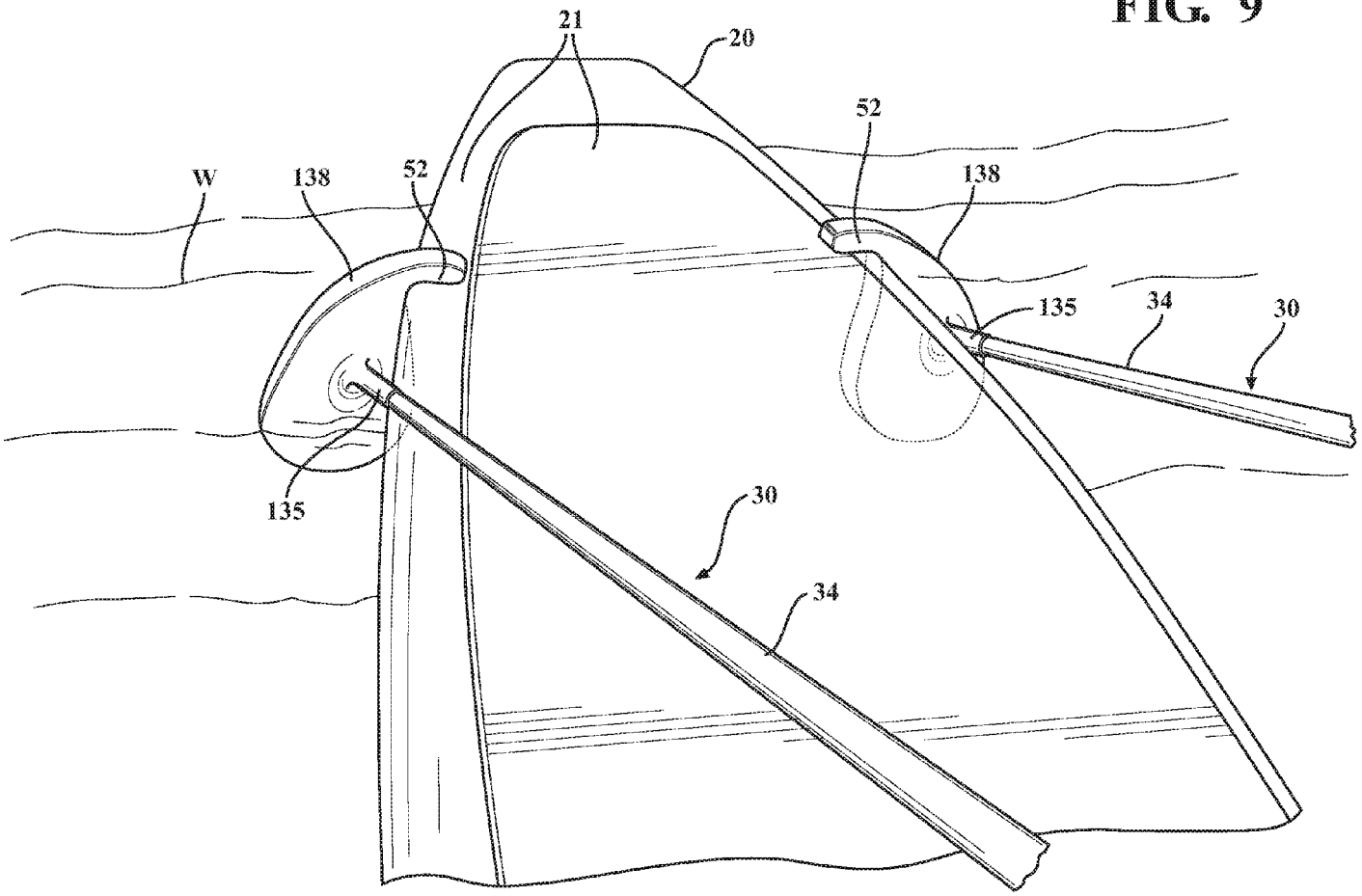
FIG. 9 is similar to FIG. 5, but shows paddles in use with the modified blades of FIG. 6.

Still referring to FIGS. 3 and 4, and also to FIG. 5, each blade 30 includes an inwardly-facing and -extending shoulder 52 at its upper end 48, projecting inwardly beyond a lower portion 44*b* of inner edge 44 so that it projects over the upper surface 21 of toward paddleboard 20 and making the upper end of the blade wider than the lower end of the blade. Shoulder 52 forms a guide or ledge or "hook" that helps locate and keep blade 30 engaged with the paddleboard throughout the paddling stroke, especially during the push stroke where it rides along the top surface of the paddleboard, preventing the blade from submerging too deeply into the water during the push stroke, and further preventing the blade from straying inwardly underneath the paddleboard during the paddling stroke. This sliding interaction between blade 38 and board 20 further increases the ease and efficiency of the paddling stroke.

Referring next to FIGS. 6-9, each paddle 30 is shown with a modified blade 138 similar to blade 38 in FIGS. 1-5 above, but with a more rounded overall shape; narrower shoulder 152; wider lower end 150 in proportion to upper end 148; and a modified shaft attachment and location 135 at lower shaft end 34*b*.

Paddle blades 138 in FIGS. 6-9 show shaft 34 attached to the blade front face at a point closer to lower end 150 than to upper end 148, i.e. offset below the midpoint or mid-line X of the blade, which position has been found to reduce the drag and the amount of lift needed on the return stroke, and further found to stabilize the push stroke. In the illustrated example, an angled aluminum ferrule 135 with a widened base portion 135*a* embedded or molded into the material of blade 138 allows the lower end 34*b* of shaft 34 to remain a straight, coaxial extension of the shaft where it attaches to the blade. The lower end of the shaft 34*b* may be detachable from the ferrule 135, for example with a removable fastener such as a screw, bolt, or detent pin 135*b* extending through the ferrule to engage the shaft or a hole in the shaft, although permanent attachment using adhesives and the like is also possible.

Further, shaft attachment ferrule 135 is secured to the front face 140 of the blade 138 at a location below the mid-line X of the blade. This reduces drag and blade lift on the return stroke, and seems to stabilize the stroke. As with the shaft attachment to blade 38 as shown in FIGS. 1-5, the shaft attachment at 135 is closer to blade inner edge 144 than to blade outer edge 146.

Still referring to blade 138 in FIGS. 6-9, the lower half of the blade below mid-line X comprises a larger portion of the total surface area of the blade. This proportion has been found to produce the most efficient pushing stroke for a given blade weight.

Description of Operation

In operation, paddler 10 standing on paddleboard 20 puts a hand through each strap 36 to grip 32. The paddler uses a ski-poling motion to move each paddle 30 forwardly with blade 38 substantially out of the water, then dips blade 38 into the water at the respective side of board 20 until shoulder 52 engages the upper surface of the board. The paddler then drives the blade 38 rearwardly with a resulting increase in tension from strap 36, straight along the side edge of board 20 with shoulder 52 sliding along the upper surface of the board, until reaching a point near the end of the board at the end of the push stroke. The stored energy in stretched strap 36 then helps the paddler return paddle 30 for a new stroke, with little or no hand/arm fatigue. The process is then repeated.

It should be understood that paddles 30 may be operated in synchronous fashion, with both paddles moving through the same paddling stroke at the same time. Alternately, paddles 30 may be used in alternating fashion, with one paddle 30 beginning a stroke while the other paddle 30 is ending a stroke.

Finally, the paddles 30 are provided in a matched set, and are used in a matched pair, with a right-hand paddle and a left-hand paddle having their respective board-engaging shoulders 52 facing in opposite directions.

It should be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A pair of independent paddle-boarding paddles, each paddle comprising:

a shaft;

a ski pole type axial grip on an upper end of the shaft and aligned with the shaft;

an elastic strap on an upper side of the upper end of the shaft adjacent the grip, the strap comprising front and rear openings and in an unstretched condition defining an elongated tunnel substantially parallel to and above the shaft and grip; and, a substantially planar blade on a lower end of the shaft, the shaft connected to a front face of the blade, and the blade set at an acute upward angle relative to a longitudinal main axis of the shaft.

2. The paddles of claim 1, wherein each blade comprises an inwardly-facing shoulder on an upper end thereof, the shoulder extending inwardly beyond a lower substantially vertical portion of an inner edge of the blade and configured to ride along an upper surface of a paddleboard.

3. The paddles of claim 2, wherein the paddles comprise a right-hand paddle and a left-hand paddle, the respective inwardly-facing shoulders of the right-hand and left-hand paddles facing in opposite directions.

4. The paddles of claim 1, wherein the blade of each paddle comprises a rear water-pushing face angled acutely from its inner to its outer edge relative to a push plane defined by the shaft, and further angled acutely from its top edge to its bottom edge, such that the blade is thicker at the inner edge than the outer edge, and thicker at the top edge than the bottom edge.

5. The paddles of claim 1, wherein the shaft of each paddle is attached to the front face of its blade closer to the blade inner edge than to the blade outer edge.

6. The paddles of claim 1, wherein the shaft of each paddle is attached to the front face of its blade closer to the blade lower end than to the blade upper end.

7. The paddles of claim 1, wherein the shaft of each paddle is attached to the front face of its blade closer to the blade inner edge than to the blade outer edge, and closer to the blade lower end than to the blade upper end.

8. A pair of independent paddle-boarding paddles, each paddle comprising:

a shaft;

a ski pole type axial grip on an upper end of the shaft and aligned with the shaft;

a strap on an upper side of the upper end of the shaft adjacent the grip; and, a substantially planar blade on a lower end of the shaft, the shaft connected to a front face of the blade, and the blade set at an acute upward angle relative to a longitudinal main axis of the shaft, the blade comprising an inwardly-facing shoulder on an upper end thereof, the shoulder extending inwardly beyond a lower substantially vertical portion of an inner edge of the blade and configured to ride along an upper surface of a paddleboard.

9. The paddles of claim 8, wherein the strap comprises an elastic strap on an upper side of the upper end of the shaft adjacent the grip, the strap comprising front and rear openings and in an unstretched condition defining an elongated tunnel substantially parallel to and above the shaft and grip.

10. The paddles of claim 9, wherein the strap of each paddle has a width from its front opening to its rear opening greater than the diameter of the front and rear openings.

11. The paddles of claim 8, wherein the paddles comprise a right-hand paddle and a left-hand paddle, the respective inwardly-facing shoulders of the right-hand and left-hand paddles facing in opposite directions.

12. The paddles of claim 8, wherein the blade of each paddle comprises a rear water-pushing face angled acutely from its inner to its outer edge relative to a push plane defined by the shaft, and further angled acutely from its top edge to its bottom edge, such that the blade is thicker at the inner edge than the outer edge, and thicker at the top edge than the bottom edge.

13. The paddles of claim 8, wherein the shaft of each paddle is attached to the front face of its blade closer to the blade inner edge than to the blade outer edge.

14. The paddles of claim 1, wherein the shaft of each paddle is attached to the front face of its blade closer to the blade lower end than to the blade upper end.

15. The paddles of claim 1, wherein the shaft of each paddle is attached to the front face of its blade closer to the blade inner edge than to the blade outer edge, and closer to the blade lower end than to the blade upper end.

* * * * *